US007318764B2

(12) United States Patent
Elias

(10) Patent No.: US 7,318,764 B2
(45) Date of Patent: Jan. 15, 2008

(54) 3-DIMENSIONAL ASSEMBLY

(76) Inventor: Fabio Elias, 7885 Candlestick La., #306, Midvale, UT (US) 84047

( * ) Notice: Subject to any disclaimer, the term of this patent is extended or adjusted under 35 U.S.C. 154(b) by 29 days.

(21) Appl. No.: 11/378,016

(22) Filed: Mar. 17, 2006

(65) Prior Publication Data

US 2006/0228979 A1 Oct. 12, 2006

Related U.S. Application Data

(60) Provisional application No. 60/670,302, filed on Apr. 12, 2005.

(51) Int. Cl.
*A63H 33/08* (2006.01)
*A63H 33/00* (2006.01)

(52) U.S. Cl. ..... 446/108; 446/120; 273/153 R

(58) Field of Classification Search ..... 446/71, 446/108, 114, 120, 121; 273/153 R, 156, 273/160; 428/8–12
See application file for complete search history.

(56) References Cited

U.S. PATENT DOCUMENTS 927,499 A * 7/1909 Davis ..... 434/214
2,067,527 A 1/1937 Greene
2,081,893 A * 5/1937 Lozier ..... 428/11
2,977,701 A 4/1961 Louderback
4,055,690 A 10/1977 Patterson
4,065,220 A * 12/1977 Ruga ..... 403/169
4,082,356 A * 4/1978 Johnson ..... 297/440.13
4,666,163 A * 5/1987 Hirschfeld ..... 273/293
D390,807 S 2/1998 Otto
5,762,336 A 6/1998 Miller
6,439,945 B1 8/2002 Liu

* cited by examiner

*Primary Examiner*—Kien T Nguyen
(74) *Attorney, Agent, or Firm*—Bateman IP Law Group

(57) ABSTRACT

A 3-dimensional assembly is constructed from three 2-dimensional pieces. Each piece is formed with two slots such that the pieces are operatively identical and are interchangeable, and such that the pieces may be formed into a structure without bending of the pieces, and such that the pieces do not all share a common line of intersection. The resulting 3-dimensional structure may be used as a toy, puzzle, ornament, engineering structure, etc.

24 Claims, 14 Drawing Sheets

3-DIMENSIONAL ASSEMBLY

RELATED APPLICATIONS

The present application claims the benefit of U.S. Provisional Patent Application No. 60/670,302, filed Apr. 12, 2005, which is incorporated herein in its entirety.

BACKGROUND OF THE INVENTION

1. The Field of the Invention

The present invention relates to a decorative 3-dimensional assembly. More specifically, the present invention relates to a 3-dimensional structure which is assembled from 3 flat pieces and which may be used as a puzzle, toy, decoration, engineering structure, etc.

2. State of the Art 3-dimensional structures are desirable for numerous uses such as decorations or toys. Additionally, structures which require assembly are often used as puzzles, toys, and the like. Existing structures are somewhat limited as to how the structure may be assembled. For example, some 3-dimensional structures have pieces which are all oriented such that each planar piece falls along a common axis. Other 3-dimensional structures require bending of the individual pieces to assemble the pieces into the resulting structure, limiting the choice of materials used to make the structure.

It is thus desirable to provide a 3-dimensional structure which may be assembled with minimal or no bending of the pieces or which allows the individual pieces to be assembled so as to be disposed in various intersecting planes.

SUMMARY OF THE INVENTION

It is an object of the present invention to provide an improved 3-dimensional structure. In particular, a structure is provided which may be assembled from interlocking 2-dimensional pieces.

According to one aspect of the present invention, a structure is provided in which 2-dimensional pieces may be assembled into a 3-dimensional structure. The pieces may be disposed at right angles to each other once assembled. According to another aspect of the present invention, the 2-dimensional pieces may be formed such that each of the pieces is functionally identical. Thus, each piece may have identical interconnecting slots or cuts and the pieces are interchangeable in constructing the resulting 3-dimensional assembly.

These and other aspects of the present invention are realized in a 3-dimensional assembly as shown and described in the following figures and related description.

BRIEF DESCRIPTION OF THE DRAWINGS

Various embodiments of the present invention are shown and described in reference to the numbered drawings wherein:

FIG. 6 shows a top view of another piece of a 3-dimensional structure according to the present invention;

It will be appreciated that the drawings are illustrative and not limiting of the scope of the invention which is defined by the appended claims. The various embodiments shown accomplish various aspects and objects of the invention.

DETAILED DESCRIPTION

The drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
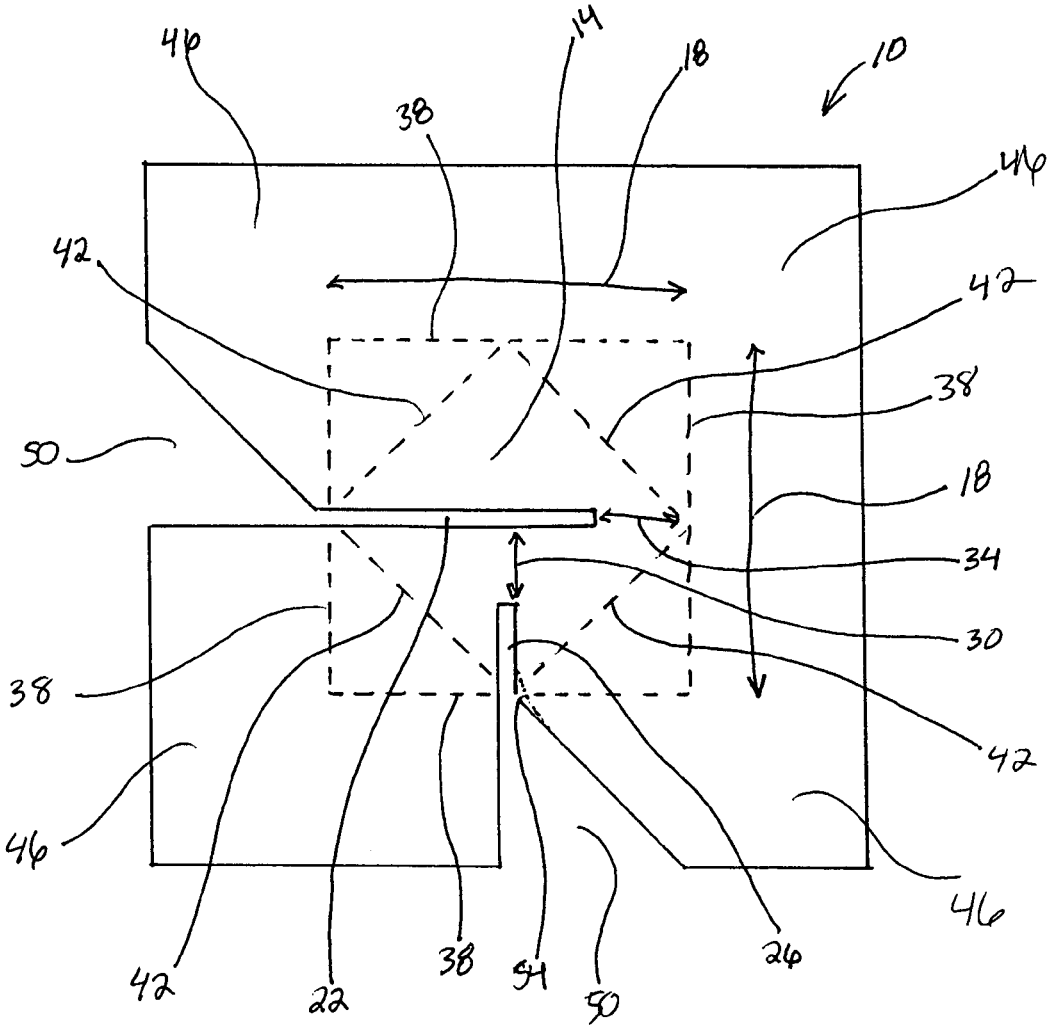
FIG. 1 shows a top view of a piece of a 3-dimensional structure according to the present invention.

Turning to FIG. 1, a plan view of a 2-dimensional piece used to form a 3-dimensional assembly is shown. The piece, indicated generally at 10, has been cut from a generally planar material. The piece 10 has an attachment section 14 having a size indicated by arrows 18 which define the size of attachment section 14, and which interlocks 3 of such pieces together into a 3-dimensional assembly. A primary slot 22 and secondary slot 26 are formed in section 14. The slots are formed such that the width of the slots 22, 26 is equal to or slightly larger than the thickness of the material used to form the piece 10, and such that the length of slot 26 is equal to length 18 minus the length of slot 22. When pieces 10 are assembled into a 3-dimensional structure, slot 22 of a first piece is inserted into slot 26 of a second piece and the relationship between the lengths of slots 22 and 26 maintains proper alignment of the two pieces 10. It will be appreciated that length 30 plus the length of slot 26 is equal to half of length 18. Optimum strength of a piece 10 occurs when slot 26 is about one fourth of length 18 and slot 22 is about three-fourths of length 18, such that length 30 is equal to length 34 and is equal to one-fourth of length 18. However, other lengths may be used.

The piece 10 may be made so as to be equal to or smaller than attachment section 14. Thus, a square piece 10 as defined by dashed square outline 38 may be formed. Pieces 10 of other shapes, such as is defined by dashed diamond outline 42, may be formed by removing material from square 38 while leaving slots 22, 26 intact. Thus, many shapes having straight or curved lines may be formed by removing material from square 38 while leaving slots 22, 26 intact. Additionally, other shapes of pieces 10 larger than square 38, utilizing area 46, may be formed, allowing a multitude of possible shapes. If the piece 10 is larger than square 38, relief cuts as shown by triangular cutout areas 50 must be made to allow assembly of pieces 10 into a 3-dimensional structure. (As shown below, it will be appreciated that the relief cuts need not be triangular.) Additionally, assembly is made easier if the corner 54 between slot 26 and corresponding relief cut 50 is rounded somewhat. Thus, the piece 10 may be made in any shape desired so long as the piece 10 has properly sized slots 22, 26 and relief cuts 50. Additionally, various pieces 10 which have different shapes may be assembled into a 3-dimensional structure so long as the pieces 10 have the same thickness and the same size of slots 22, 26, and relief cuts 50 (i.e. dimension 18 is the same for each piece).

Figure 2:
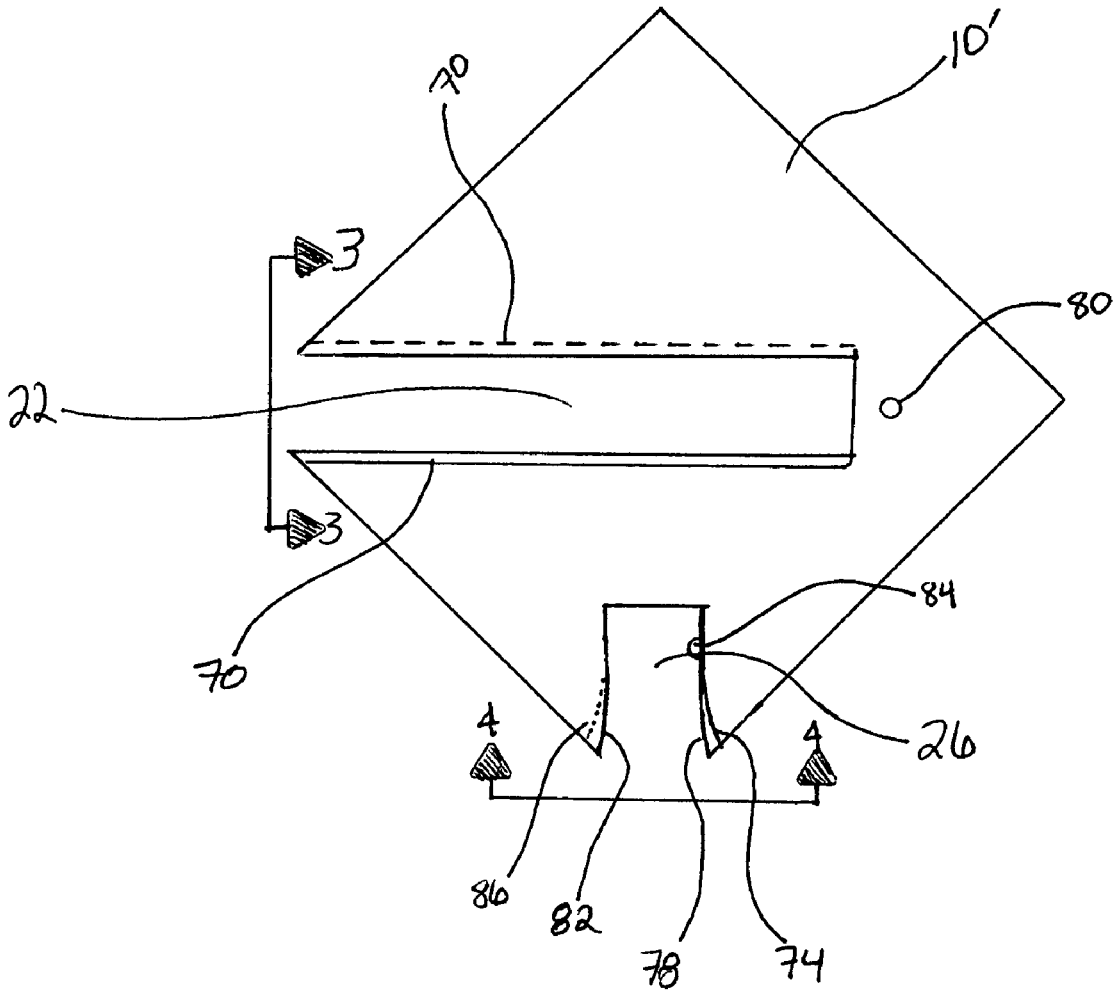
FIG. 2 shows a top view of another piece of a 3-dimensional structure according to the present invention.

Turning now to FIG. 2, a top view of another piece of a 3-dimensional structure is shown. The piece 10' is formed along diamond shape 42 of FIG. 1. The piece 10' has slots 22 and 26 formed therein. In order to facilitate assembly of the 3-dimensional structure, slot 22 may have bevels 70 formed therein, as may be seen more clearly in FIG. 3. Additionally, slot 26 is formed such that the outer edge of the slot 26 curves outwardly, beginning about half way out from the inside of the slot 26. Slot 26 is curved such that upper edge 74 of the right side of the slot 26 is curved out up to 25 degrees and preferably about 15 degrees, while lower edge 78 of the right side of the slot 26 is curved out up to 10 degrees and preferably about 5 degrees. Upper edge 82 of the left side of slot 26 is curved out up to 10 degrees, and preferably about 5 degrees, and lower edge 86 (dashed line) of the left side of slot 26 is curved out up to 25 degrees and preferably about 15 degrees.

The curvature formed in slot 26 and the bevels 70 formed in slot 22 allow pieces 10 to be oriented at less than 90 degree angles relative to each other while assembling the 3-dimensional structure, which is necessary for assembly. For thicker pieces 10 or 10' or pieces formed from rigid material, the bevels are necessary to allow assembly yet provide a tightly fitting 3-dimensional structure. Conversely, the slots 22, 26 may simply be cut wider than is necessary to allow assembly without cutting the bevels 70 and curvature 74, 78, 82, 86. In order to achieve a more rigid assembled structure (one which does not have excessive movement between the pieces, especially where the slots are made somewhat wider than the thickness of the pieces of material), detents or dimples 80 and corresponding bumps 84 maybe added to the pieces such that the bumps 84 engage the adjacent dimples 80 of the adjacent other piece when assembled, locking the structure more securely in place. It is appreciated that the dimples may be formed as bumps and vice versa. Any such engaging structure may be used at the joints between the pieces of the resulting 3-dimensional assembly. It is appreciated that the use of such an engaging structure allows the pieces to fit together more loosely during assembly allowing for easier assembly, while still fitting more tightly together in a completed form. For pieces 10 made of thinner and somewhat flexible materials, the pieces 10 will flex slightly during assembly such that bevels 70 and curvature 74, 78, 82, 86 are not necessary.

Figure 3:
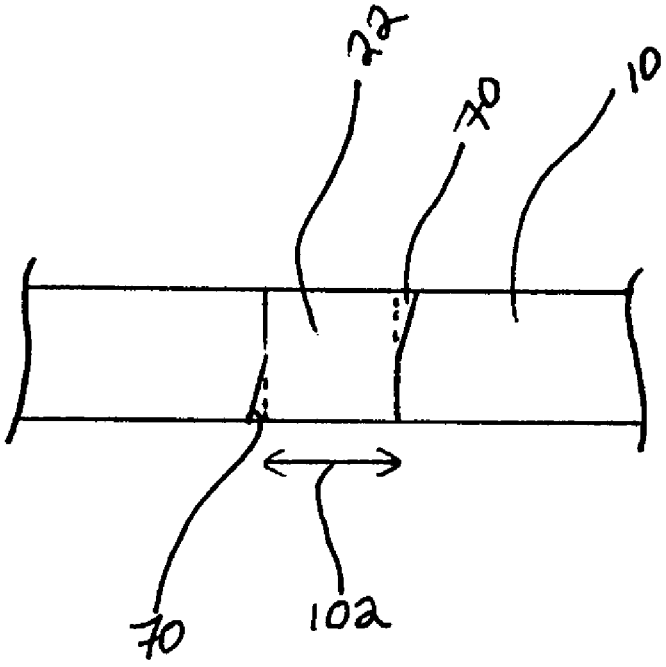
FIG. 3 shows a side view of the structure piece of FIG. 2 taken along line 3-3.

Turning now to FIG. 3, and end view of slot 22 of FIG. 2 is shown. The slot 22 formed in piece 10 has a width, indicated by arrow 102, approximately equal to the thickness of the piece 10. Bevels 70 are formed in the slot 22 such that the upper right edge of the slot 22 is beveled outwardly and the lower left edge of the slot 22 is beveled outwardly. The bevels are preferably formed of an angle of approximately 15 degrees relative to the surface of the slot 22 and extend across approximately half of the vertical height of the slot 22.

Figure 4:
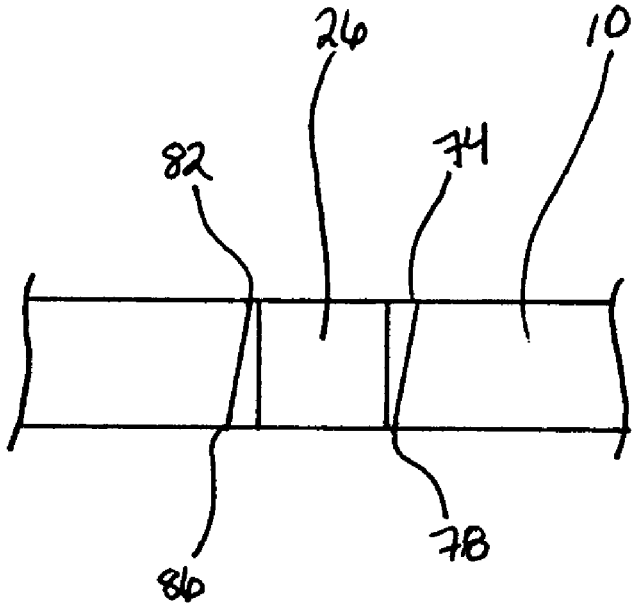
FIG. 4 shows a side view of the structure piece of FIG. 2 taken along line 4-4.

Turning now to FIG. 4, a end view of slot 26 of FIG. 2 is shown. The slot 26 is formed in piece 10 such that the back portion of the slot is roughly square, being about the same width as the thickness of the piece 10. The edges of the slot 26 then are beveled or curve outwardly as they extend towards the front of the slot 26. Upper right edge 74 curves outwardly approximately 15 degrees relative to the back of the slot. Lower right edge 78 curves out about 5 degrees. Upper left edge 82 curves out about 5 degrees and lower left edge 86 curves out about 15 degrees. The beveled and curved slots 22, 26 shown in FIG. 2 through FIG. 4 allow a pieces 10 of substantial thickness to be assembled into a 3-dimensional structure.

Figure 5:
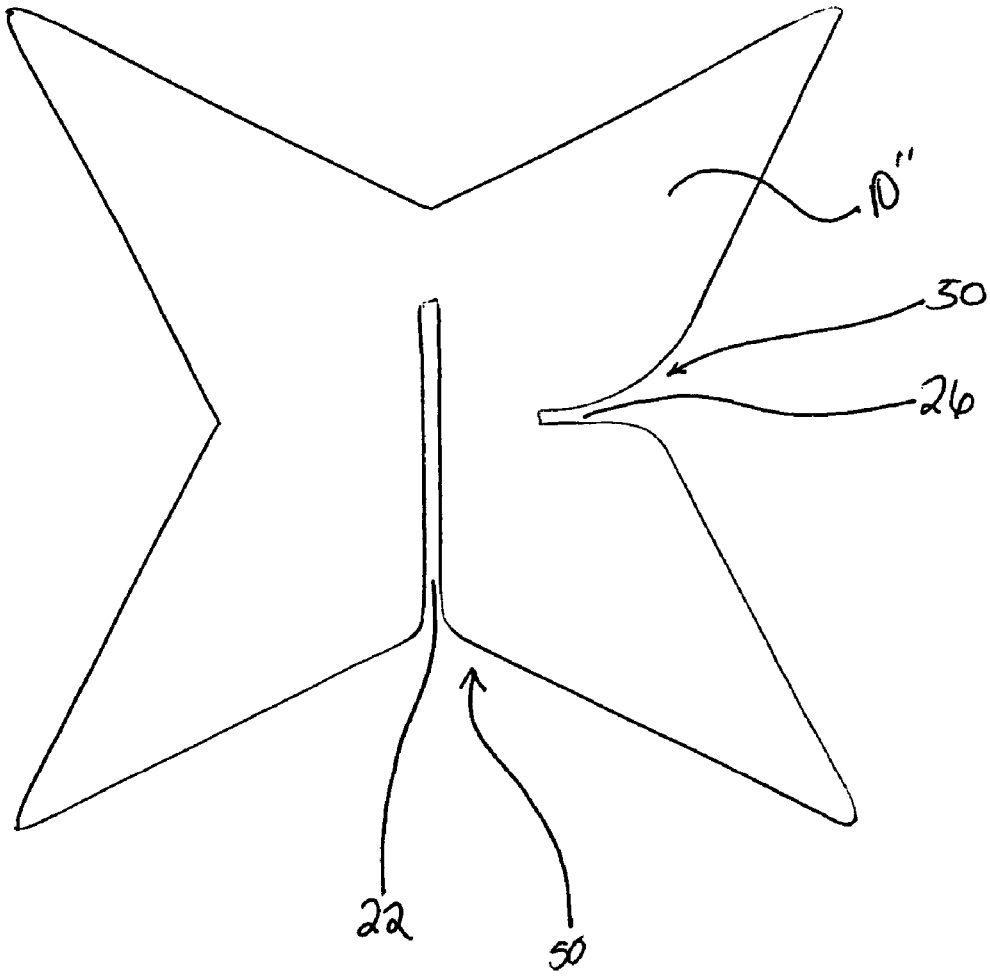
FIG. 5 shows a top view of another piece of a 3-dimensional structure according to the present invention.
Figure 4:
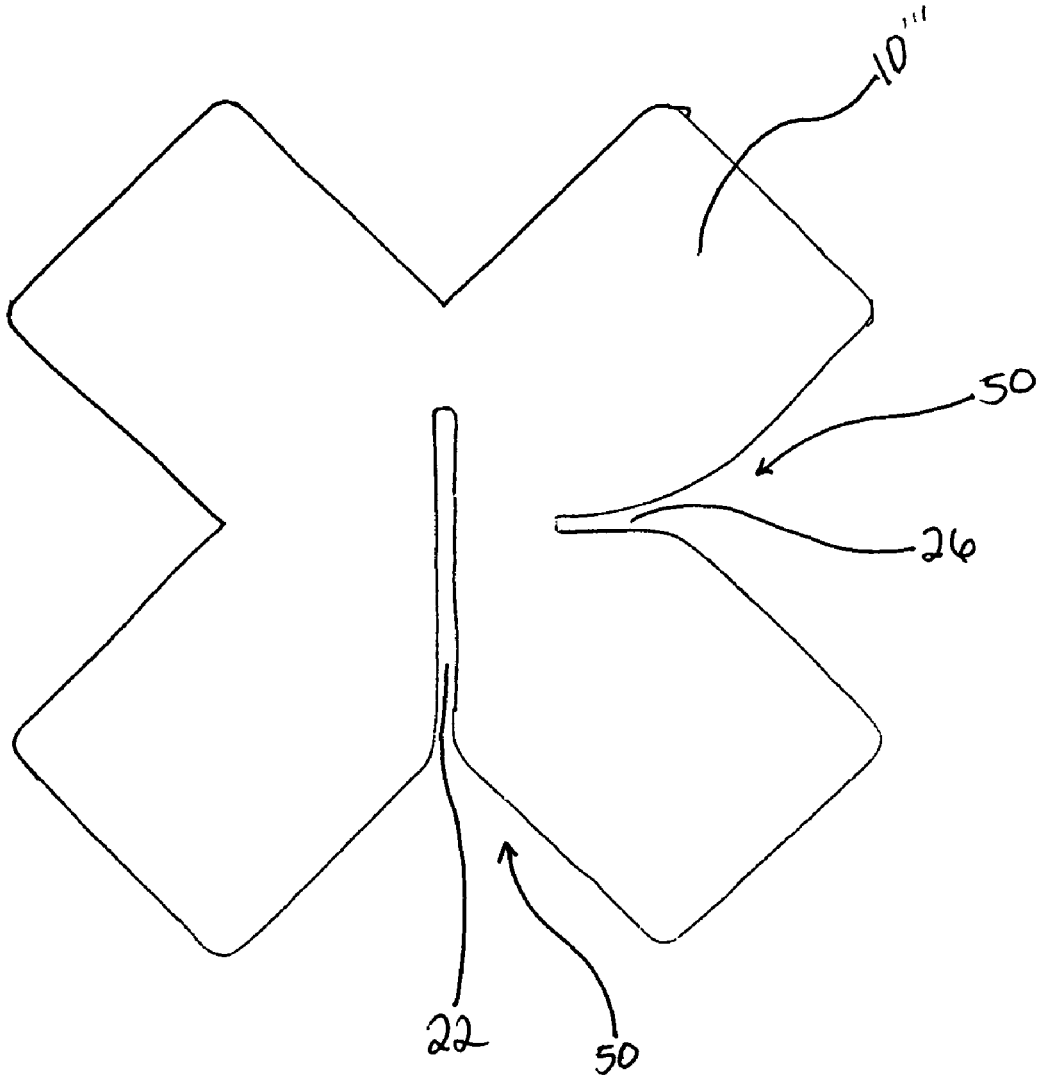

Turning now to FIG. 5, a top view of a piece of a 3-dimensional structure is shown. The piece 10" is formed in the shape of a star and includes slots 22, 26 and cutout areas 50 to facilitate assembly. It will thus be appreciated that the cutout areas 50 can be mirrored on other sides of piece 10" to preserve a symmetrical shape of the piece 10.

Turning now to FIG. 6, a top view of another structure piece is shown. The piece 10''' is formed in the shape of a cross and includes slots 22, 26 and cutout areas 50. Individual pieces 10''' may be formed in any number of different shapes.

Figure 7:
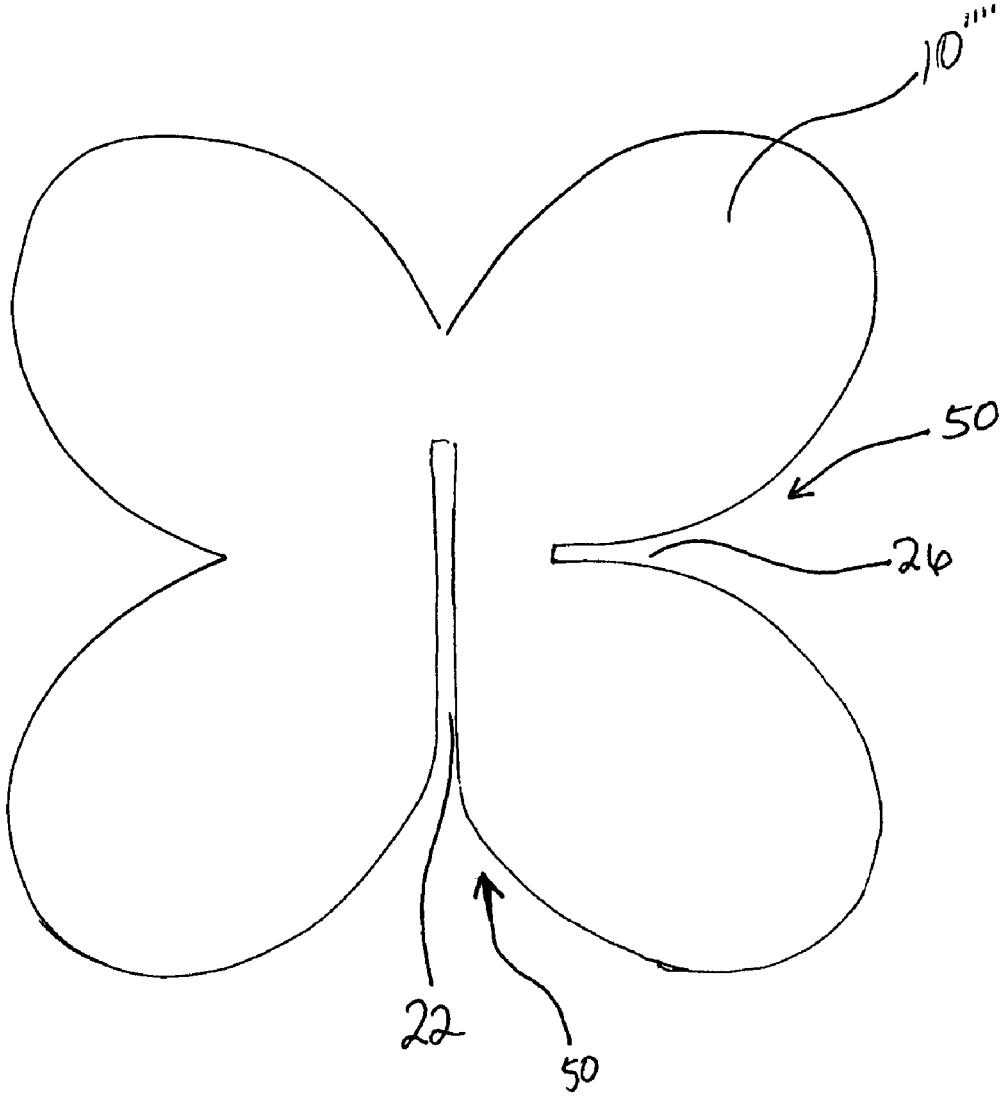
FIG. 7 shows a top view of another piece of a 3-dimensional structure according to the present invention.

Turning now to FIG. 7, a top view of another structure piece according to the present invention is shown. The piece 10'''' has been formed as a butterfly or flower-like shape. The piece 10'''' includes slots 22, 26 and cutout areas 50 to facilitate assembly.

Figure 8:
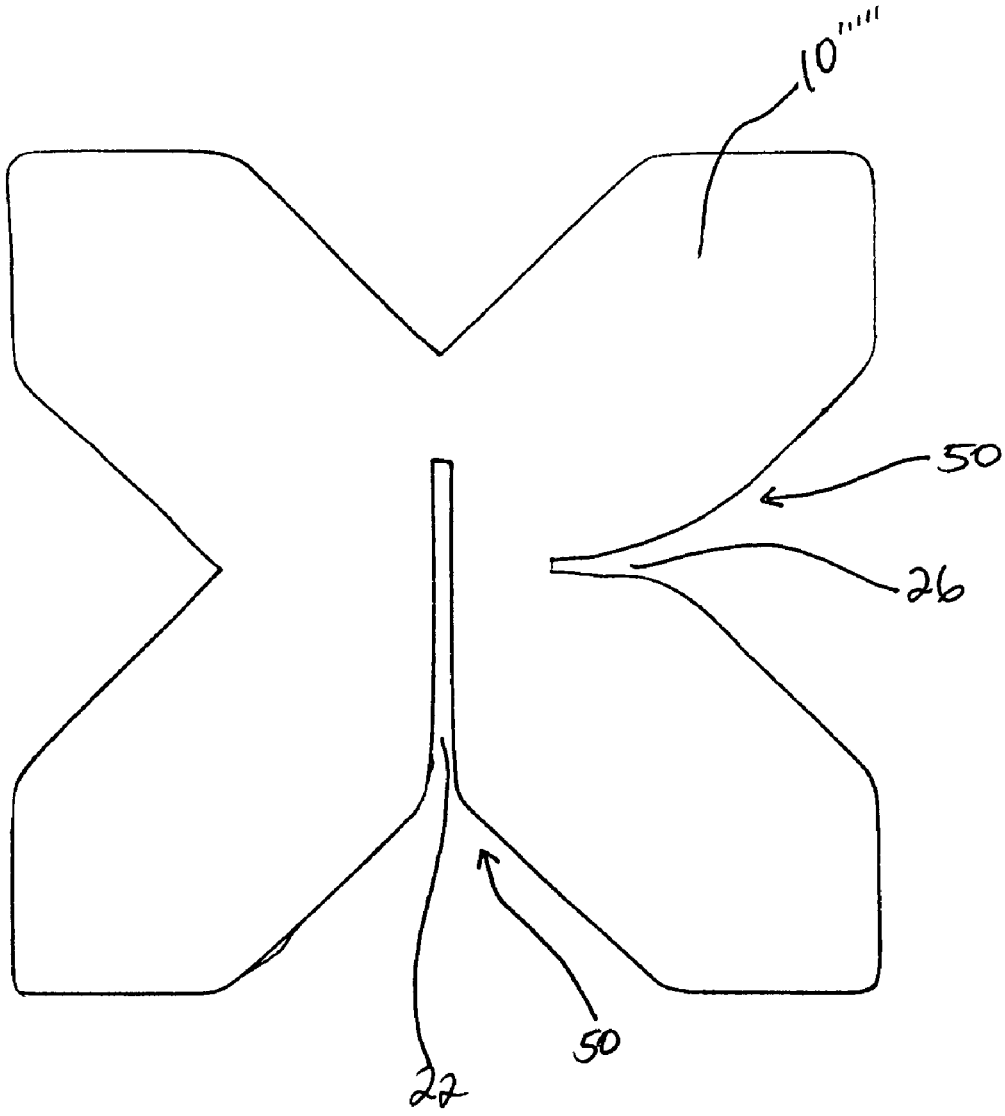
FIG. 8 shows a top view of another piece of a 3-dimensional structure according to the present invention.

Turning now to FIG. 8, a top view of another structure piece according to the present invention is shown. The piece 10''''' is formed in a cross shape. The piece 10''''' includes slots 22, 26 and cutout areas 50 so as to allow assembly of three such pieces into a 3-dimensional structure.

Figure 9:
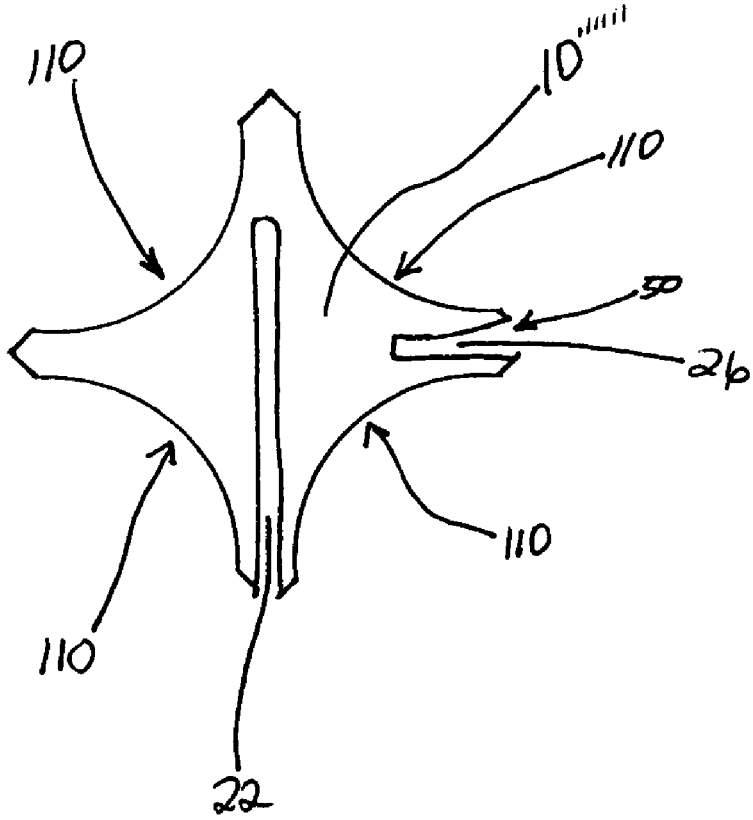
FIG. 9 shows a top view of another piece of a 3-dimensional structure according to the present invention.

Turning now to FIG. 9, a top view of yet another structure piece according to the present invention is shown. The piece 10'''''' has been formed into a curved cross shape, and includes slots 22, 26 and a cutout area 50 to allow three of such pieces 10'''''' to be assembled into a 3-dimensional structure. The piece 10'''''' has been formed so as to have cutout portions 110 which extend inwardly between slots 22, 26. In comparison, FIG. 5 through FIG. 8 show pieces 10 where tabs extend outwardly from the slots 22, 26. It will thus be appreciated that any shape may be made so long as the integrity of the slots 22, 26 is preserved, and ample cutout areas 50 exist where necessary for assembling three pieces 10 into a 3-dimensional structure. It will also be appreciated that while pieces 10-10'''''' have been shown which exhibit radial symmetry, non-symmetric pieces are also possible. Nearly any shape which is desired may be made. Thus, the pieces may be formed such that when three pieces are assembled into a 3-dimensional structure, the resulting structure resembles a desired object, such as a star, snowflake, or even a comic character.

Figure 10:
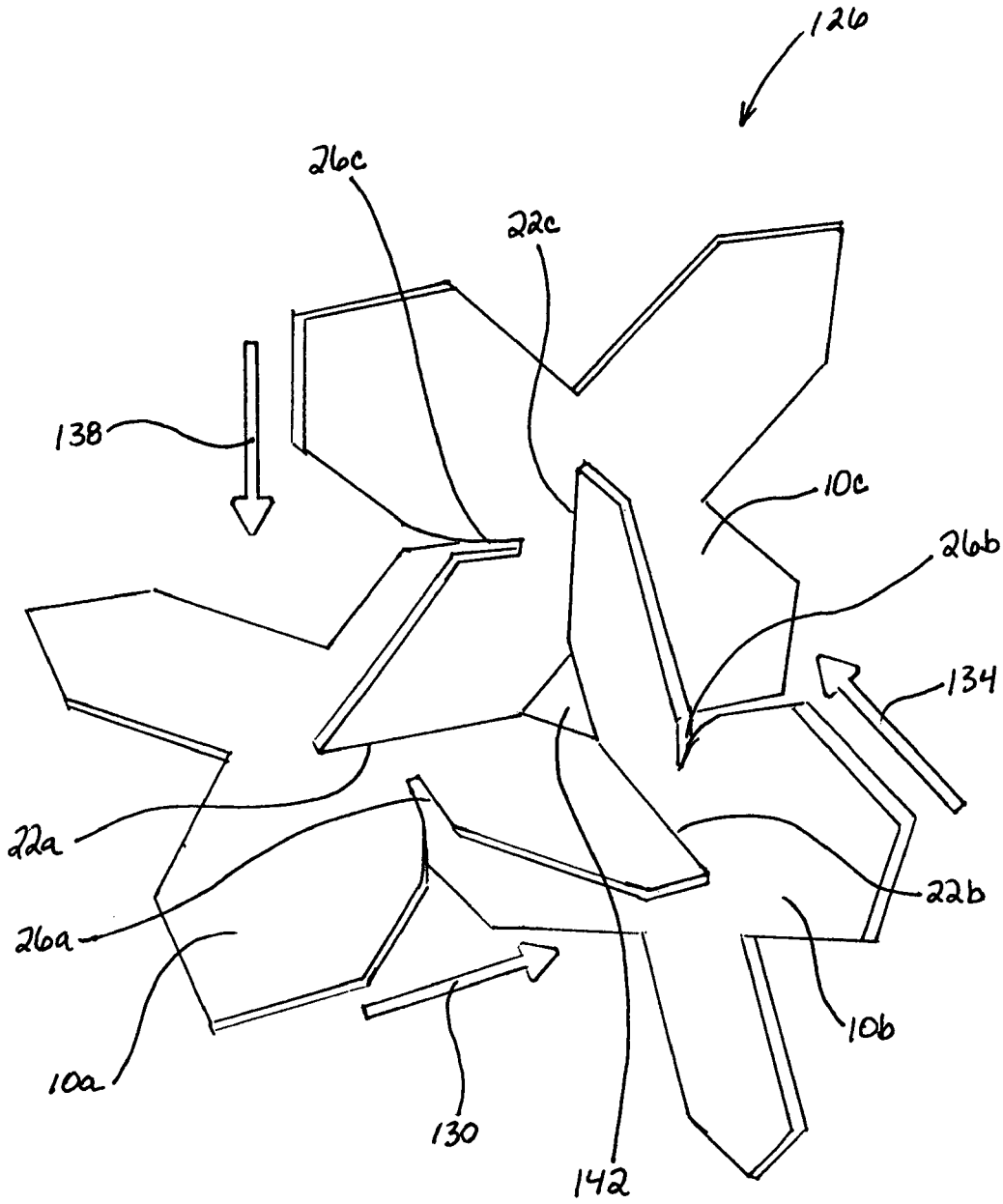
FIG. 10 shows a perspective view of a 3-dimensional structure according to the present invention.

Turning now to FIG. 10, a perspective view of a 3-dimensional assembly according to the present invention is shown. The assembly, indicated generally at 126, comprises a first piece 10*a*, a second piece 10*b*, and a third piece 10*c*. As shown, the pieces 10*a*, 10*b*, 10*c* are disposed in a first step of assembly, wherein piece 10*c* is disposed in the slot 22*a* of piece 10*a*, piece 10*a* is disposed in slot 22*b* of piece 10*b*, and piece 10*b* is disposed in slot 22*c* of piece 10*c*. Pieces 10*a*, 10*b*, 10*c* are disposed substantially perpendicular to each other. Additionally, the pieces 10*a*, 10*b*, 10*c* are arranged in such a manner that as piece 10*a* is moved in the direction of arrow 130 slot 22*b* moves towards slot 26*a* wherein slot 22*b* engages slot 26*a*. Similarly, as piece 10*b* is moved in the direction of arrow 134 slot 26*b* moves to engage slot 22*c* and as piece 10*c* moves in the direction of arrow 138 slot 26*c* moves to engage slot 22*a*. As shown, a small triangular opening 142 is formed between pieces 10*a*, 10*b*, and 10*c*. As the pieces 10*a*, 10*b*, 10*c* are simultaneously moved in the direction of arrows 130, 134, 138, opening 142 disappears.

Figure 11:
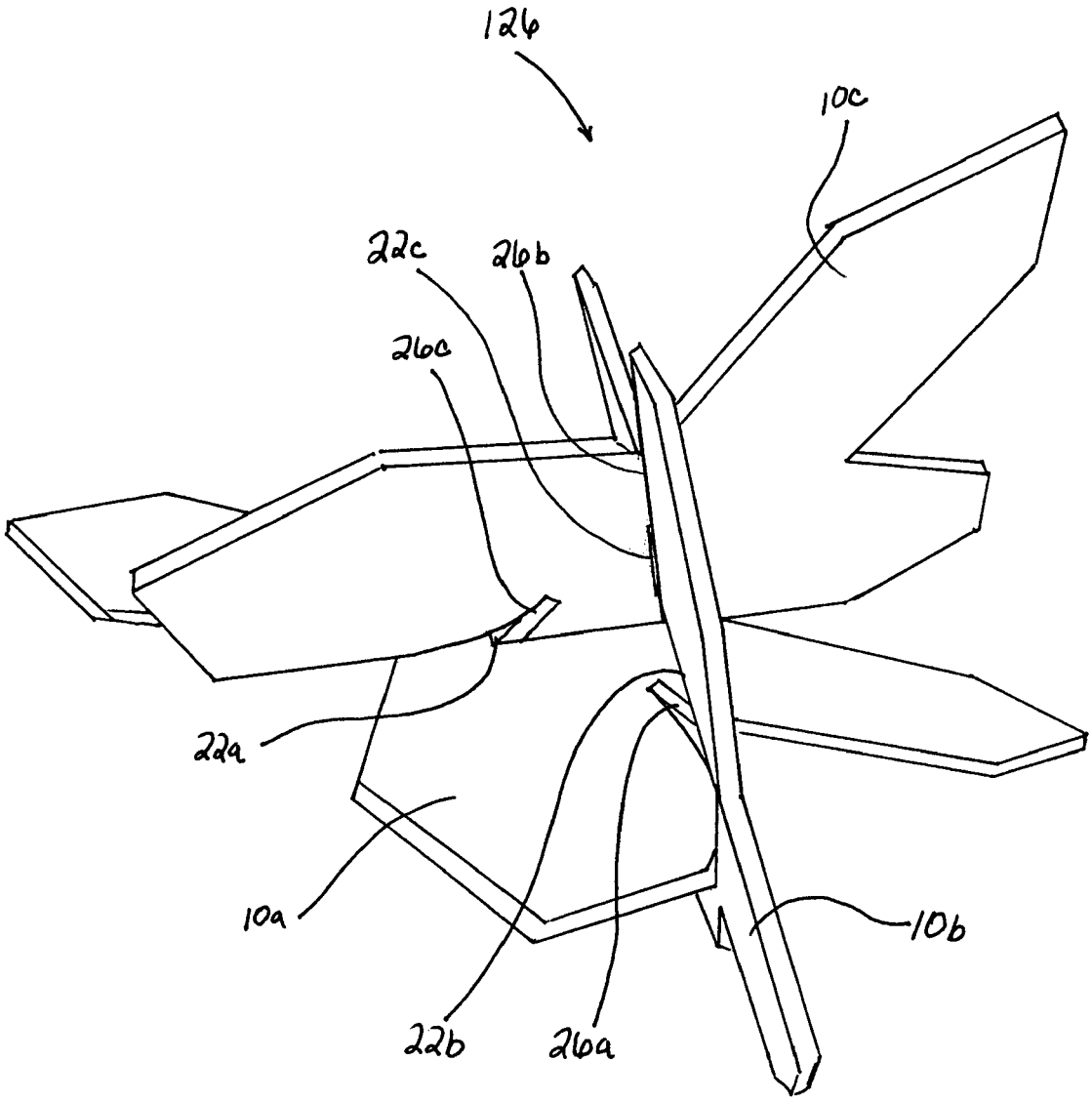
FIG. 11 shows another perspective view of a 3-dimensional structure according to the present invention.

Turning now to FIG. 11, another perspective view of a 3-dimensional assembly according to the present invention is shown. The assembly 126 is the same assembly shown in FIG. 10. As opening 142 (FIG. 10) disappears, the pieces 10*a*, 10*b*, 10*c* are rotated so as to be at an angle slightly less than perpendicular to each other, approximately 75 degrees, allowing slot 22*a* to engage slot 26*c*, slot 22*b* to engage slot 26*a*, and slot 22*c* to engage slot 26*b*, as is shown. At this point during the construction process of assembly 126, the openings of slots 22*a*, 22*b*, 22*c* all meet in the location of opening 142 (FIG. 10). Pieces 10*a*, 10*b*, 10*c* are then rotated so as to be once again perpendicular to each other, allowing slot 22*a* to fully engage slot 26*c*, slot 22*b* to fully engage slot 26*a*, and slot 22*c* to fully engage slot 26*b*.

Figure 12:
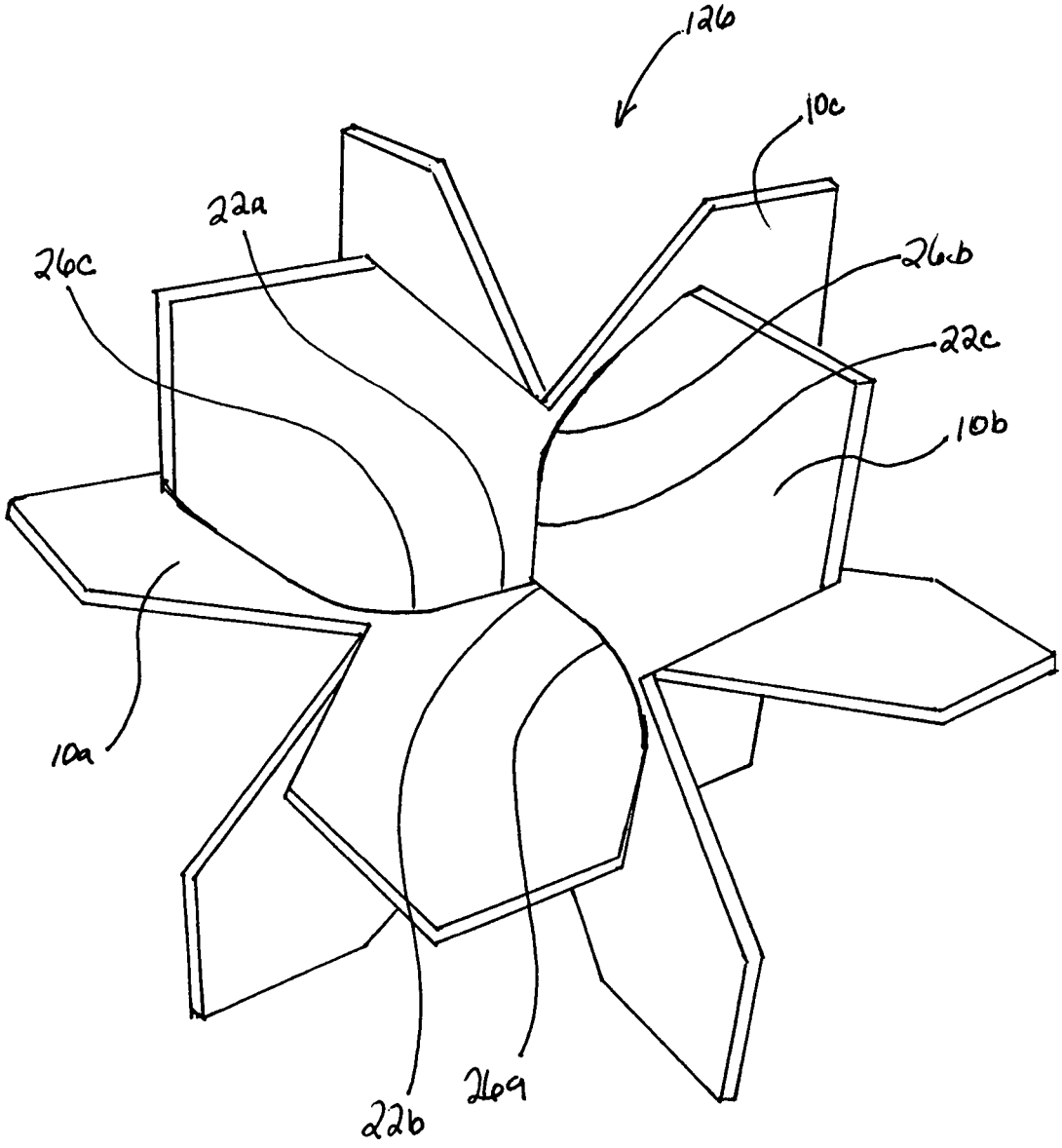
FIG. 12 shows yet another perspective view of 3-dimensional structure according to the present invention.

Turning now to FIG. 12, a perspective view of the completed 3-dimensional assembly of FIG. 10 and FIG. 11 is shown. Pieces 10*a*, 10*b*, 10*c* have been rotated and moved into a position wherein each of the pieces 10*a*, 10*b*, 10*c* are perpendicular to each other, and wherein slot 22*a* fully engages slot 26*c*, slot 22*b* fully engages slot 26*a*, and slot 22*c* fully engages slot 26*b*.

Figure 13:
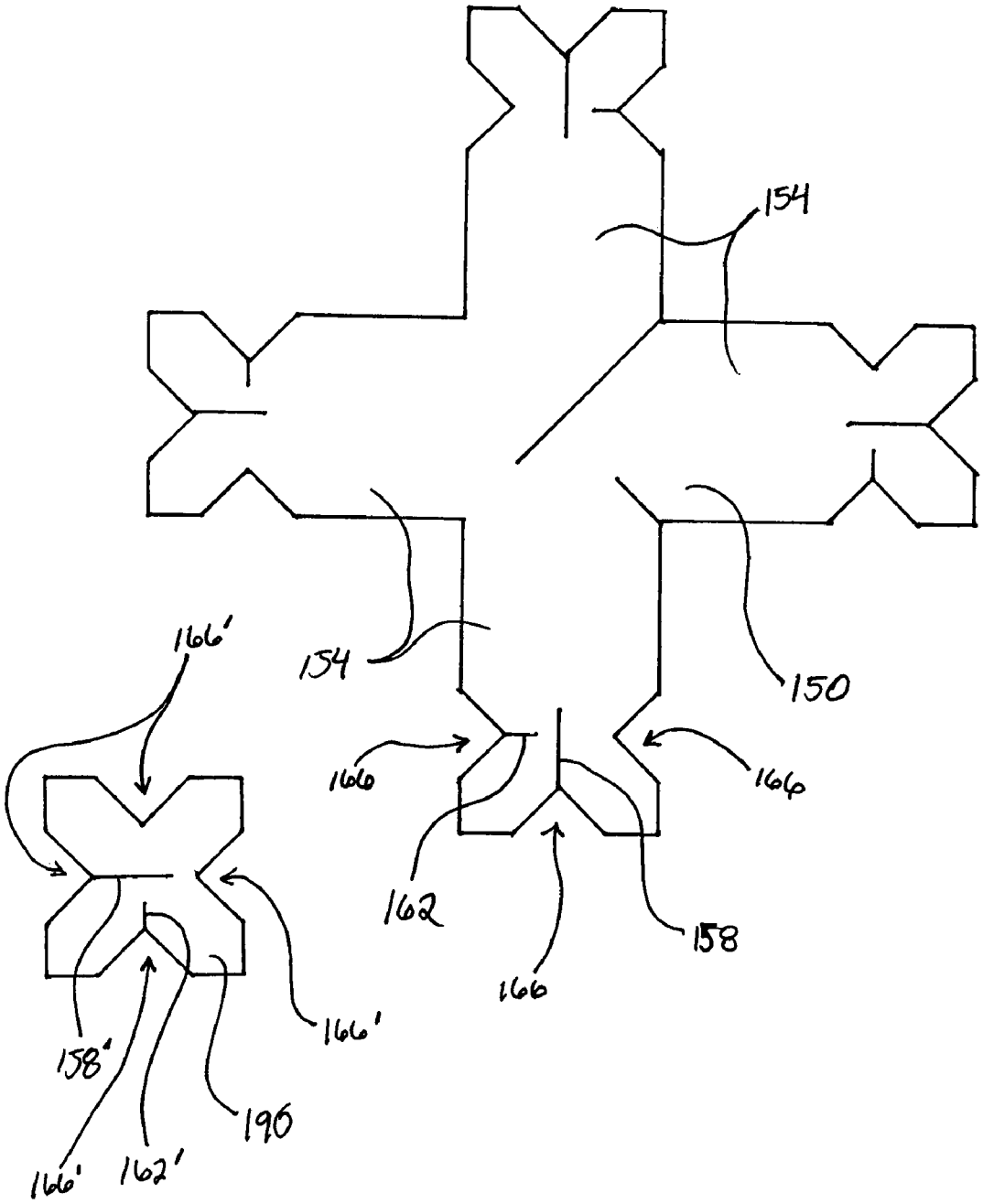
FIG. 13 shows top views of pieces of a 3-dimensional structure according to the present invention.

Turning now to FIG. 13, a top view of pieces of a 3-dimensional structure of the present invention is shown. The three dimensional structure is functionally similar to the 3-dimensional structures shown earlier, and will thus be discussed in less detail as the assembly and use of the structure is similar to the earlier embodiments. The structure differs in that smaller 3-dimensional structures are added to a primary 3-dimensional structure. Thus, three of pieces 150 are assembled as discussed previously to form a 3-dimensional structure.

Additionally, the pieces 150 are formed such that arms 154 extend outwardly from the piece. The end of each arm 154 has been formed with slots 158, 162 such that the end of the arm 154 may be assembled as part of an additional 3-dimensional structure with pieces 190. The ends of arms 154 may thus be formed with notches or openings 166 as is aesthetically desired or as is required for assembly of the additional 3-dimensional structure. Piece 190 of the additional 3-dimensional structure has slots 158 and 162 which functionally engage slots 158, 162 during assembly such that two of pieces 190 and the end of arm 154 are assembled to form a 3-dimensional assembly as has been previously discussed. Pieces 190 may be formed with notches or openings 166' corresponding to notches or openings 166.

It is thus appreciated that two of pieces 190 are required to form a 3-dimensional assembly with each arm 154 of piece 150. Thus, if twelve arms 154 are formed on piece 150, twenty four of pieces 190 are required to form 3-dimensional assemblies on the end of each arm 154. It is also appreciated that it is not necessary to form 12 arms on piece 150. Each of piece 150 may contain one, two, three, four, or more arms 154 extending from the piece, and any or all of these arms 154 may be assembled into additional 3-dimensional assemblies as is desired. Thus, the number and shape of smaller 3-dimensional assemblies made with arms 154 and pieces 190 may be altered such that the resulting assembly has any of a variety of possible shapes and appearances.

Figure 14:
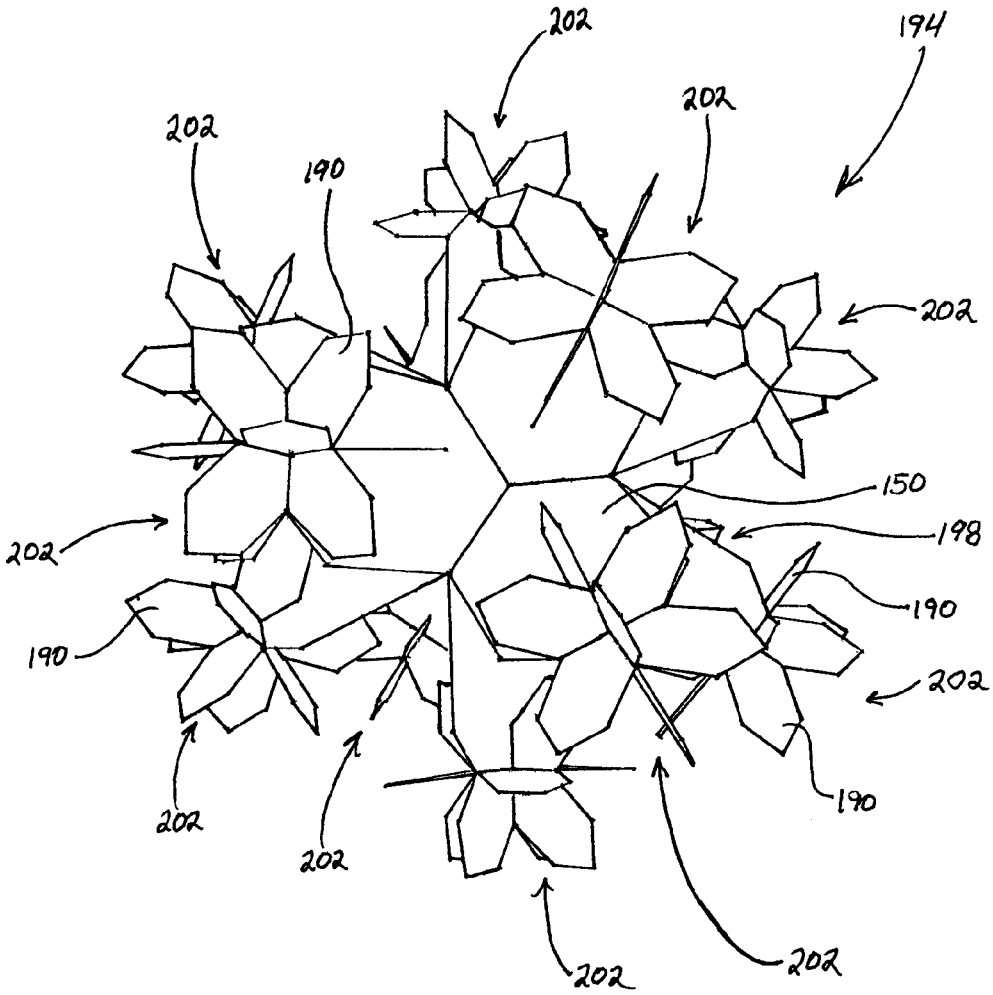
FIG. 14 shows a perspective view of a 3-dimensional structure according to the present invention.

Turning now to FIG. 14, a perspective view of a 3-dimensional assembly resulting from assembly of the pieces of FIG. 13 is shown. The assembly, indicated generally at 194, includes a 3-dimensional assembly 198 constructed of pieces 150 of FIG. 13, and further includes twelve smaller 3-dimensional assemblies 202 constructed of pieces 190 of FIG. 13. One smaller 3-dimensional assembly 202 is formed on each arm of the larger 3-dimensional assembly 198. It is thus appreciated that a variety of structures may be formed by including one or more 3-dimensional assembly according to the present invention. Multiple 3-dimensional assemblies of the same or varying sizes may be attached together to result in any combination of assemblies.

There is thus disclosed an improvement in a 3-dimensional assembly. It will be appreciated that the various embodiments shown are illustrative of the various aspects of the present invention and should not limit the pending claims.

What is claimed is:

1. A 3-dimensional structure formed from three separate pieces, the pieces being generally planar and being configured so as to be slidably engageable such that each of the three pieces is disposed generally perpendicular to the remaining two pieces and such that the three pieces share a common point of intersection and such that the three pieces do not share a common line of intersection;

wherein each of the three pieces has a first slot extending inwardly from an edge thereof and a second slot extending inwardly from an edge thereof and generally perpendicular to the first slot; and wherein simultaneously: the first slot of the first piece engages the second slot of the second piece, the first slot of the second piece engages the second slot of the third piece, and the first slot of the third piece engages the second slot of the first piece.

2. The structure of claim 1, wherein at least one surface of the first slot is partially beveled.

3. The structure of claim 2, wherein the first slot has at least one bevel of about 15 degrees.

4. The structure of claim 1, wherein the outer portion of the second slot curves outwardly so as to widen the slot.

5. The structure of claim 1, wherein the first slot is at least two times as long as the second slot.

6. The structure of claim 5, wherein the first slot is three times as long as the second slot.

7. The structure of claim 1, wherein each of the three pieces has a first slot and a second slot perpendicular to the first slot and wherein each of the three pieces is configured for simultaneously engaging the other two of the three pieces, and wherein each of the three pieces is operatively identical such that any of the three pieces may be interchanged with any other of the three pieces.

8. The structure of claim 1, wherein the three pieces are disposed in three separate geometric planes, each of the three planes being substantially perpendicular to the other two planes.

9. A 3-dimensional structure formed from:

a first generally planar piece having a first slot and a second slot disposed generally perpendicularly to each other;

a second generally planar piece having a first slot and a second slot disposed generally perpendicularly to each other;

a third generally planar piece having a first slot and a second slot disposed generally perpendicularly to each other;

wherein the first, second, and third pieces are operatively interchangeable with each other; and wherein each of the first, second, and third pieces are simultaneously interconnected with both of the other pieces of the first, second, and third pieces by engaging the first slot of the piece with the second slot of another piece to form a three dimensional structure.

10. The 3-dimensional structure of claim 9, wherein the first slot and second slot of the first piece, the second piece and the third piece each comprise a first slot and a second slot shorter then the first slot.

11. The 3-dimensional structure of claim 10, wherein each of the first piece, the second piece and the third piece comprises an attachment section having a length, and wherein the first slot and the second slot each have lengths, and wherein the combined lengths of the first slot and the second slot is substantially the same as the slot of the attachment section.

12. The 3-dimensional structure of claim 10, wherein the first slot is at least two times the length of the second slot.

13. The 3-dimensional structure of claim 12, wherein the first slot is three times as long as the second slot.

14. The 3-dimensional structure of claim 10, wherein the first slot has a beveled portion.

15. The 3-dimensional structure of claim 14, wherein the beveled portion is angled at about 15 degrees.

16. The 3-dimensional structure of claim 10, wherein the second slot is beveled.

17. The 3-dimensional structure of claim 16, wherein each of the first piece, the second piece and the third piece comprise a cutout adjacent at least one of the slots.

18. A kit for forming a three dimensional structure, the kit comprising:

a first piece having a first slot and a second slot disposed generally perpendicular to the first slot;

a second piece having a first slot and a second slot disposed generally perpendicular to the first slot; and a third piece having a first slot and a second slot disposed generally perpendicular to the first slot; and wherein, for the first piece, second piece, and third piece, the first slot is disposed in the same position relative to the second slot such that the first piece, second piece, and third piece are operatively identical; and wherein the first piece, second piece, and third piece are configured for simultaneous assembly into a 3-dimensional assembly wherein the first piece, second piece, and third piece share a common point of intersection without sharing a common line of intersection.

19. The kit for forming a three dimensional structure of claim 18, wherein the first slots of the first piece, the second piece and the third piece are substantially the same length.

20. The kit for forming a three dimensional structure of claim 18, wherein the second slots of the first piece, the second piece and the third piece are substantially the same length.

21. The kit for forming a three dimensional structure of claim 18, wherein the first piece, second piece, and third piece are generally planar, and wherein the first piece has a thickness, the second piece has a thickness similar to the thickness of the first piece, and the third piece has a thickness similar to the thickness of the first piece.

22. The kit for forming a three dimensional structure of claim 21, wherein the first slots of the first piece, the second piece and the third piece are of a width slightly greater than the thickness of the first piece.

23. The kit for forming a three dimensional structure of claim 21, wherein the second slots of the first piece, the second piece and the third piece are of a width slightly greater than the thickness of the first piece.

24. A method for forming a three dimensional structure, the method comprising:

selecting a first piece, a second piece and a third piece, each piece being generally planar and having a first slot and a second slot, the second slot being disposed generally perpendicular to the first slot, the first piece, second piece, and third piece being operatively identical; and inserting the third piece into the first slot of the first piece, the second piece into the first slot of third piece, and the first piece into the first slot of the third piece; and advancing the pieces until the first piece is disposed substantially perpendicular to the second piece and the third piece, the second piece is disposed substantially perpendicular to the first piece and the third piece, and the third piece is disposed generally perpendicular to the first piece and the second piece, and such that simultaneously: the first slot of the first piece engages the second slot of the third piece, the first slot of the second piece engages the second slot of the first piece, and the first slot of the third piece engages the second slot of the second piece.

* * * * *

UNITED STATES PATENT AND TRADEMARK OFFICE

CERTIFICATE OF CORRECTION

PATENT NO. : 7,318,764 B2
APPLICATION NO. : 11/378016
DATED : January 15, 2008
INVENTOR(S) : Fabio Elias It is certified that error appears in the above-identified patent and that said Letters Patent is hereby corrected as shown below:

Column 3:
Line 55, it reads "Turning now to FIG. 3, and end…"; should read --Turning now to FIG. 3, an end…--
Line 65, it reads "Turning now to FIG. 4, a end…"; should read --Turning now to FIG. 4, an end…--

Column 5:
Line 44, it reads "...has slots 158 and 162 which"; should read --...has slots 158' and 162' which--

Column 6:
Line 6, it reads "...3-dimensional assemby according"; should read --...3-dimensional assemblies according--

Column 8:
Line 31, it reads "...first slot of third piece…"; should read --...first slot of the third piece…--

Signed and Sealed this

Seventeenth Day of February, 2009

John Doll

JOHN DOLL
*Acting Director of the United States Patent and Trademark Office*